United States Patent [19]

Isa et al.

[11] Patent Number: 4,550,569

[45] Date of Patent: Nov. 5, 1985

[54] MAIN STEAM INLET STRUCTURE FOR STEAM TURBINE

[75] Inventors: Hitoshi Isa; Ryoichi Kaneko; Katsuto Kashiwahara, all of Hitachi, Japan

[73] Assignee: Hitachi, Ltd., Tokyo, Japan

[21] Appl. No.: 619,533

[22] Filed: Jun. 11, 1984

[30] Foreign Application Priority Data

Jun. 10, 1983 [JP] Japan ..... 58-102631

[51] Int. Cl.[4] ..... F01K 19/00

[52] U.S. Cl. ..... 60/657; 60/647; 60/677; 415/176; 415/178

[58] Field of Search ..... 60/646, 647, 653, 657, 60/677; 415/115, 176, 178

[56] References Cited

U.S. PATENT DOCUMENTS 2,467,818 4/1949 Elston ..... 415/176 X
2,815,645 12/1957 Downs ..... 415/178 X

FOREIGN PATENT DOCUMENTS 562942 9/1958 Canada ..... 415/176
943052 5/1956 Fed. Rep. of Germany .
81859 6/1956 Netherlands ..... 415/178

OTHER PUBLICATIONS

"The Eddystone Superpressure Unit", Transactions of the ASME, Aug. 1957, pp. 1431-1446.
"Development Associated with the Superpressure Turbine for Eddystone Station Unit No. 1", ASME Paper Nos. 59-A-288, 1960.

*Primary Examiner*—Stephen F. Husar
*Attorney, Agent, or Firm*—Antonelli, Terry & Wands

[57] ABSTRACT

A main steam inlet structure of a steam turbine has two inlet tubes which are separable from an inner casing and an outer casing of the turbine and are arranged concentrically with a spacing therebetween to constitute an inflow passage for main steam are connected at one end to the outer casing and at the other end to the inner casing, by seal rings. Cooling steam extracted from turbine stage midway is supplied to a cooling steam passage of the spacing formed between the two inlet tubes, thereby cooling the inner inlet tube.

11 Claims, 4 Drawing Figures

MAIN STEAM INLET STRUCTURE FOR STEAM TURBINE

BACKGROUND OF THE INVENTION

The present invention relates to a steam inlet structure for a steam turbine, and more particularly to a steam inlet structure for the ultrahigh-temperature, high-pressure section of a ultrahigh-temperature steam turbine.

In the latter half of the 1950's several ultrahigh-temperature, high-pressure thermal power stations were constructed and went into operation, such as the Philo thermal power station unit No. 6 (steam conditions: 4500 Psig (316 atg), 1150° F. (592° C.)) and the Eddystone thermal power station unit No. 1 (steam conditions: 5000 Psig (352 atg), 1200° F. (649° C.)).

Thereafter, because these ultrahigh-temperature, high-pressure plants use large quantities of high-grade heat-resistant materials, and the cost of their equipment has greatly increased, plants with steam conditions of a maximum of 245 atg (3500 Psig) and 566° C. (1050° F.) have been employed.

Due to the recently increased cost of crude oil, however, attention has been again directed to ultrahigh-temperature, high-pressure plants which can provide a higher efficiency.

Because the steam turbine of an ultrahigh-temperature, high-pressure plant has a high steam inlet temperature, the ultrahigh-temperature steam inlet unit must be made of expensive heat-resistant austenite steel. But making this unit entirely of such a heat-resistant steel increases its cost, so that attempts have been made to utilize cooling techniques so that most of this unit can be made of a heat-resistant ferrite steel.

The turbine steam inlet structure and the cooling techniques used in the Eddystone thermal power station unit No. 1 are described in papers such as "The Eddystone Superpressure Unit (Transsaction of the ASME, August, 1957) and "Development Associated with the Superpressure Turbine for Eddystone Station Unit No. 1 (An ASME Publication, Paper Number 59-A-288, 1960). These papers disclose that the ultrahigh-temperature, high-pressure section is formed in a double casing consisting of an inner casing made of heat-resistant austenite steel and an outer casing made of heat-resistant ferrite steel, and the main steam inlet portion thereof is made of heat-resistant austenite steel and has a main steam inlet tube formed so that it is welded integrally to the forward end of the steam inlet of the outer casing. An annular slit is provided between the outer casing and the main steam inlet tube, and a heat-shielding plate of a special shape is arranged within this slit so as to reduce thermal stresses in the main steam inlet tube. Main steam flows into a nozzle chamber through the steam inlet tube, does its work, and is then discharged out of an exhaust pipe. Part of the discharged steam flows into the slit portion in the main steam inlet tube after passing between the inner and outer casings, to cool both the outer casing and the forward end of the steam inlet of the outer casing.

With this cooling structure, however, since the main steam inlet tube is formed so that it is welded integrally to the forward end of the steam inlet for the outer casing, difficulties have been encountered in the manufacture and inspection of the slit in the cooling steam passage, as well as of the heat-shielding plate in the slit. In particular, inspection during periodic checks is difficult.

The cooling structure also has the defect that stresses are liable to concentrate at the corners of the ends of the slit.

SUMMARY OF THE INVENTION

It is an object of the present invention to provide a steam inlet structure which is easy to manufacture and inspect, and which has only small thermal stresses in the steam inlet portion thereof.

The present invention is so constructed that one end of a round tube for the ultrahigh-temperature, high-pressure steam inlet is connected to an outer casing and the other end to an inner casing by seal rings, and another round tube is concentrically arranged around the outside of the first round tube, and is connected to the inner and outer casings in a similar manner. Cooling steam at a lower temperature and pressure than that of steam in the inner round tube is made to flow between the inner and outer round tube so as to reduce the difference between the pressures exerted upon the walls of the inner and outer round tubes, as well as the temperatures of the walls of the inner and outer round tubes. With this structure, a ultrahigh-temperature, high-pressure steam inlet unit can be obtained which is easy to manufacture and inspect, and which has high reliability.

DESCRIPTION OF THE PREFERRED EMBODIMENT

Figure 1:
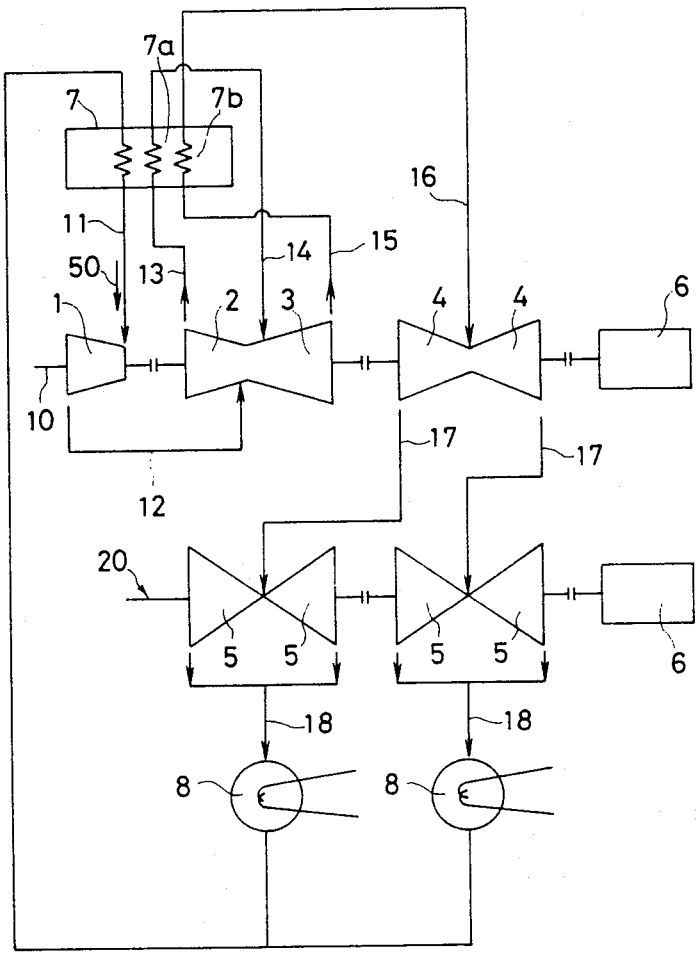
FIG. 1 is a schematic view of an ultrahigh-pressure, high-temperature steam turbine plant.

FIG. 1 is a schematic view of the cycle of a two-stage reheating steam power plant with main steam condition of 352 ata (5000 Psig) and 649° C. (1200° F.), and an output capacity of 1000 MW.

This power plant is constituted as a cross-compound type in which an ultrahigh-pressure top turbine 1, a high-pressure turbine consisting of an ultrahigh-pressure section 2 and a high-pressure section 3 formed within an integral casing, and a medium-pressure turbine 4 of a double-flow structure are connected to a first shaft 10. Two low-pressure turbines 5 of a double-flow structure are connected to a second shaft 20. Each of the first and second shafts have a power generator 6.

Main steam 50 generated by a boiler 7 flows into the ultrahigh-pressure top turbine 1 through a main steam line 11, does its work in the ultrahigh-pressure top turbine 1, and then flows into the ultrahigh-pressure section 2 of the high-pressure turbine through a discharge line 12 for the ultrahigh-pressure top turbine. Thereafter, the steam is introduced from the ultrahigh-pressure section 2 through an ultrahigh-pressure discharge line 13 to the boiler 7, where it is reheated by a primary reheater 7*a*. The reheated steam then flows into the high-pressure section 3 of the high-pressure turbine through a first reheated-steam line 14 to do its work in the high-pressure section 3. The steam leaving the high-pressure section 3 is returned through a high-pressure discharge line 15 to the boiler 7 where it is reheated by a secondary reheater *7b*, and the reheated steam flows into the medium-pressure turbine 4 through a second reheated-steam line 16. The steam then flows into the low-pressure turbines 5 through medium-pressure discharge lines 17, and is introduced through condenser lines 18 to condensers 8, where it condensed into water, which is returned to the boiler 7 by a feed pump (not shown).

In this cycle, the main steam introduced into the ultrahigh-pressure top turbine 1 is, as previously noted, under very high temperature and pressure and, therefore, the inlet structure of the top turbine 1 must have a sufficiently high reliability so that it can withstand such high-temperature, high-pressure conditions.

Figure 2:
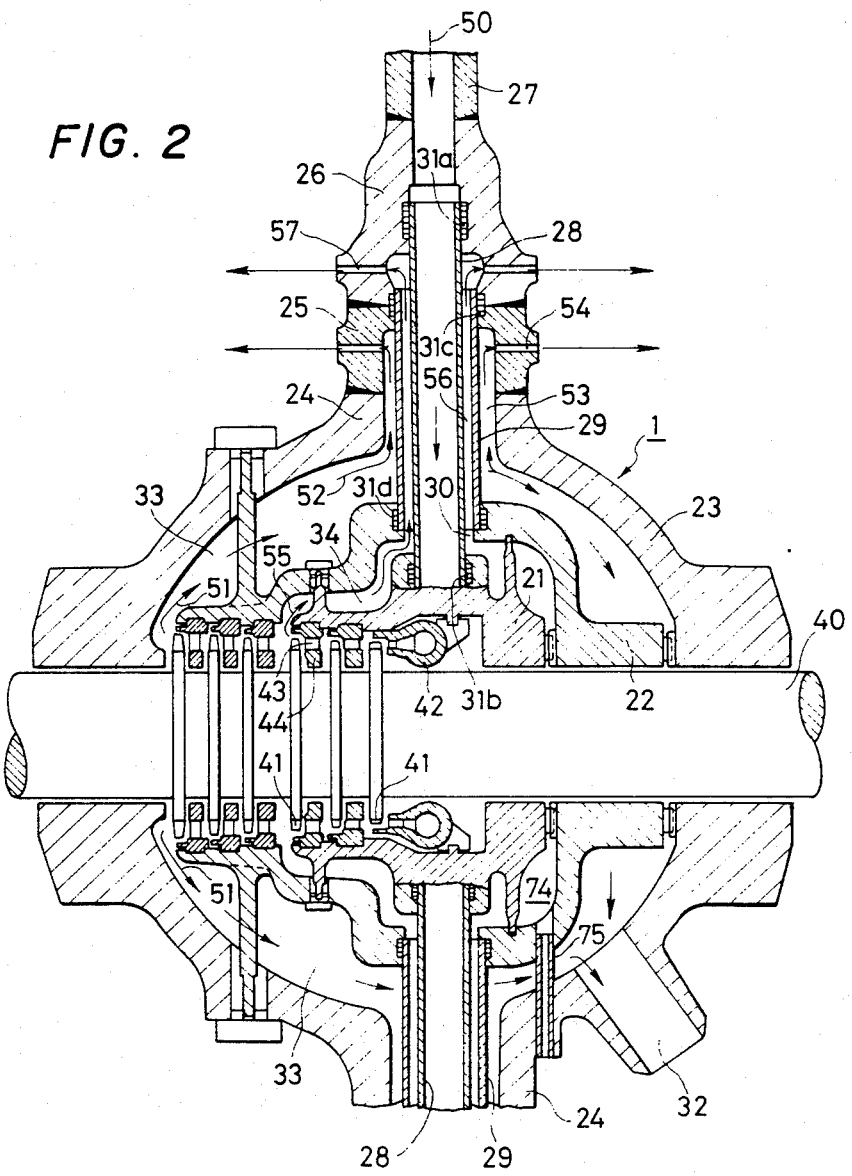
FIG. 2 is a sectional view of an embodiment of an ultrahigh-pressure top turbine according to the present invention.

FIG. 2 is a sectional view of the structure of the ultrahigh-pressure top turbine 1. Referring to FIG. 2, the casing of the top turbine 1 has a triple structure comprising a first inner casing 21, a second inner casing 22 and an outer casing 23, in that order from the inside out. The first inner casing 21 which is subjected to the highest temperatures is fabricated of heat-resistant austenite steel, while the second inner casing 22 and the outer casing 23 are fabricated of heat-resistant ferrite steel. A discharge chamber is formed between the outer casing 23 and the second inner casing 22, with spacing sufficient enough to enable the discharge steam to flow therethrough, the discharge chamber communicating with the discharge line 12 through a discharge tube 32. A cooling steam chamber 34, to which is introduced cooling steam extracted from a stage midway within the top turbine, is formed between the first inner casing 21 and the second inner casing 22. The outer casing 23 has tubular openings 24 at its upper and lower ends which allow steam to flow thereinto. A second main steam inlet coupling 25 in the form of a round tube fabricated of a Ni-based superalloy is welded to the upper tubular opening 24, and a first main steam inlet coupling 26 in the form of a round tube fabricated of a heat-resistant austenite material is in turn welded to the second main steam inlet coupling 25. The first main steam inlet coupling 26 is similarly welded to a main steam connecting tube 27 of heat-resistant austenite steel so that it is integral therewith, and the two main steam inlet couplings constitute a main steam inlet unit.

A first round inlet tube 28 fabricated of heat-resistant austenite steel is arranged within the main steam inlet unit in such a manner that the round tube 28 passes through an opening 30 in the second inner casing, one end thereof is connected to the first main steam inlet coupling 26 by a seal ring 31*a*, and the other end thereof is connected to an opening in the first inner casing 21 by a seal ring 31*b*, the opening in the first inner casing 21 communicating with a nozzle box 42 within the first inner casing 21. A main steam inflow passage is thus formed leading from the main steam connecting tube 27 through the first main steam inlet coupling 26 and the first round inlet tube 28 to the nozzle box 42 within the first inner casing 21.

A second round inlet tube 29 is concentrically arranged around the outside of the first round inlet tube 28, one end thereof is connected to the second main steam inlet coupling 25 by a seal ring 31*c*, and the other end thereof is connected to the opening 30 in the second inner casing 22 by a seal ring 31*d*.

Rotor blades 41, stator blades 43 and diaphragms 44 of the high-pressure stages, in addition to the nozzle box 42 are provided in the first inner casing 21, and the second inner casing 22 is constructed so as to surround the first inner casing 21 and the rotor blades, stator blades and diaphragms of the low-pressure stages. The discharge tube 32 of the ultrahigh-pressure top turbine is attached to a lower part of the outer casing to discharge the steam from the outer casing 23.

Main steam 50 flows into the nozzle box 42 after passing through the main steam connecting tube 27, the first main steam inlet coupling 26 and the interior of the first round inlet tube 28. The main steam then passes from the nozzle box 42 through the stator blades 43 and the rotor blades 41 of each stage, doing its work in the ultrahigh-pressure top turbine 1. Discharge steam 51 at a reduced temperature and pressure flows through the discharge chamber 33 between the second inner casing 22 and the outer casing 23 toward the discharge tube 32 of the ultrahigh-pressure top turbine, while cooling the inner wall of the outer casing 23 and the outer wall of the second inner casing 22. Part of the discharge steam 51 becomes secondary cooling steam 52 that flows through a second cooling-steam passage 53 of an annular section which is defined between the outside of the second round inlet tube 29 and the inside of the tubular opening 24 of the outer casing, as well as the second steam inlet coupling 25, while cooling the outer surface of the second round inlet tube 29, and it is then discharged from a second cooling-steam discharge port 54. Primary cooling steam 55 extracted from a stage somewhere between the high- and low-pressure stages passes through an extracted cooling-steam chamber 34 which continues off the space behind the rotor blades of the intermediate stage, while cooling the outer wall of the first inner casing 21, and then flows into a first cooling-steam passage 56 defined between the first round inlet tube 28 and the second round inlet tube 29. The primary cooling steam 55 flows through that passage 56 while cooling the outer wall of the first round inlet tube, and is then discharged from a first cooling-steam discharge port 57.

Since the primary cooling steam 55 consists of steam extracted from an intermediate stage of the top turbine, its pressure and temperature are lower than those of the main steam by an amount corresponding to the work done in the turbine stages leading to the extraction port. Since the discharge steam 51 from the top turbine is used directly as the secondary cooling steam 52, it has lower pressure and temperature than the primary cooling steam 55. In other words, the main steam 50 passes through the central part of the steam inlet unit, the primary cooling steam 55 flows round the main steam 50, and the secondary cooling steam 52 flows round the primary steam 55, so that the temperature and pressure decrease step-by-step therein.

Figure 3:
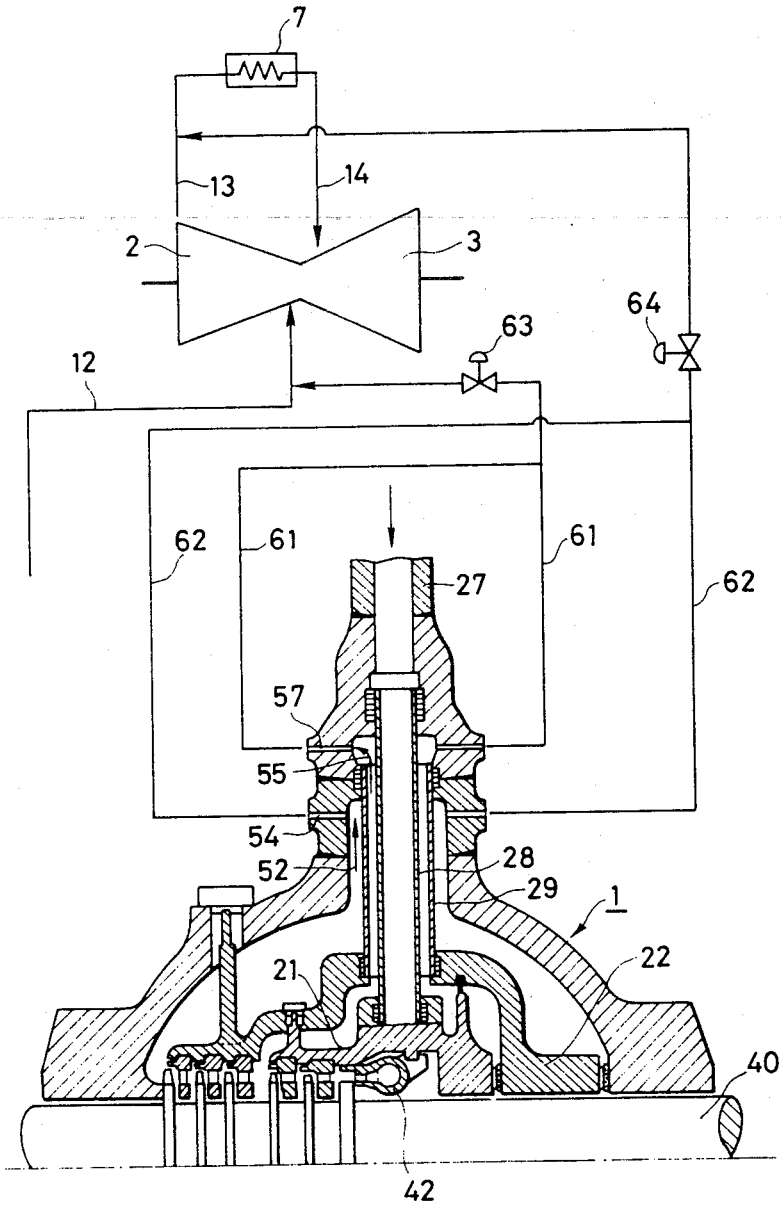
FIG. 3 is a view of a system for recovering steam discharged from each of the cooling-steam discharge ports.

FIG. 3 illustrates a system for recovering the cooling steams discharged from each of the cooling steam ports. The primary cooling steam 55 discharged from the first cooling-steam discharge port 57 flows through a first cooling-steam recovery line 61 which has a flow-regulating valve 63, and it is then recovered in a discharge line 12 for the ultrahigh-pressure top turbine. Meanwhile, the secondary cooling steam 52 flows from the second cooling-steam discharge port 54 through a second cooling-steam recovery line 62 which has a flow-regulating valve 64, and it is then recovered in a discharge line 13 for the ultrahigh-pressure section 2 of the high-pressure turbine.

The flow-regulating valve 63, 64 in each of the lines function to regulate the flow rate of the primary cooling steam 55 and the secondary cooling steam 52, and hence the occurrence of supercooling or lack of cooling in the corresponding casings and the round inlet tubes 28, 29.

Figure 4:
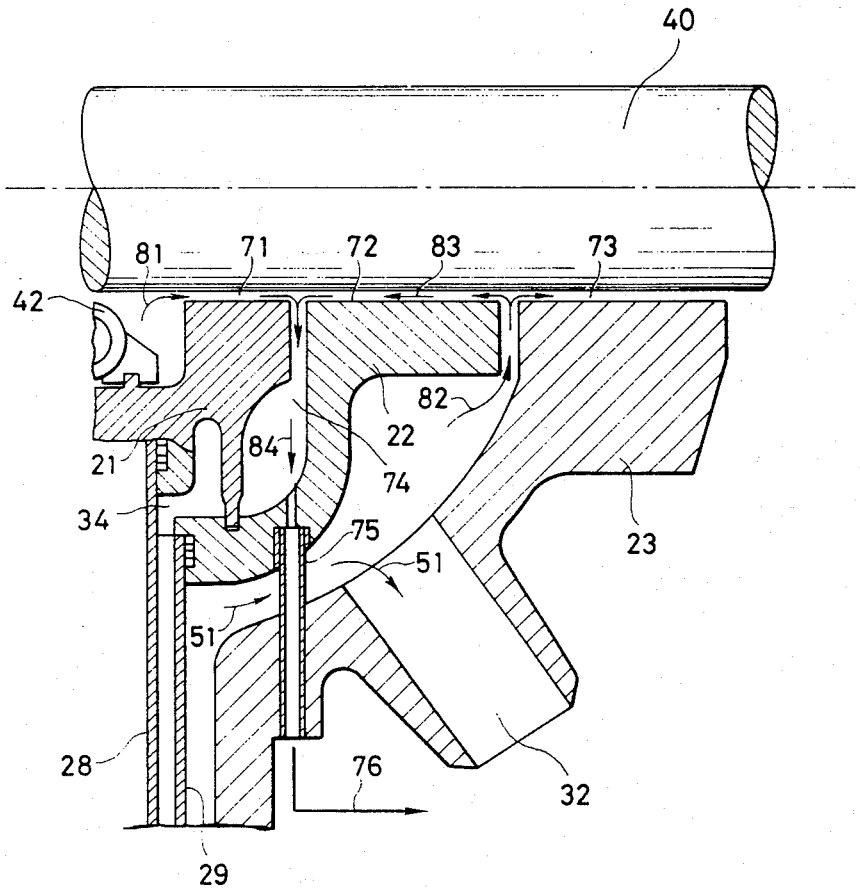
FIG. 4 is a sectional view of a shaft-sealing mechanism on the the higher-pressure side of the ultrahigh-pressure top turbine of FIG. 2.

FIG. 4 illustrates a shaft-sealing mechanism on the higher-pressure side of the ultrahigh-pressure top turbine, that is, on the side thereof opposite to the discharge side, which is directly subjected to the main steam at high pressure.

The higher-pressure side of the ultrahigh-pressure is sealed in a triple manner by a first inner casing labyrinth 71, a second inner casing labyrinth 72 and an outer casing labyrinth 73. It is constructed so that a leaked-steam chamber 74 separated from the extracted cooling-steam chamber 34 is formed between the first and second inner casings 21, 22, and a leaked-steam discharge tube 75 extends from the leaked-steam chamber 74 and passes through the second inner casing 22 and the outer casing 23. A leaked-steam line 76 connected to the leaked-steam discharge tube 75 is in turn connected to the discharge line 13 for the ultrahigh-pressure section of the high-pressure turbine, which has a lower pressure than that of the steam discharged from the ultrahigh-pressure top turbine 1.

Leaked steam 81 from the first inner casing 21 passes through the first inner casing labyrinth 71 and then flows into the leaked-steam chamber 74. Part 82 of the discharge steam 51 from the ultrahigh-pressure top turbine 1 branches off into an axial gap between the second inner casing 22 and the outer casing 23 in two directions toward the second inner casing labyrinth 72 and the outer casing labyrinth 73. Leaked steam 83 passing through the second inner casing labyrinth flows into the leaked-steam chamber 74. The steam in the leaked-steam chamber 74 is discharged into the ultrahigh-pressure discharge line 13 through the leaked-steam discharge tube 75. Since the leaked-steam chamber 74 communicates with discharge line 13 of the high-pressure turbine at an even lower pressure than that in the discharge line 12 of the ultrahigh-pressure top turbine 1, the highest-pressure leaked steam 81 can leak through the labyrinth 71, but flows into the leaked-steam chamber 74. Steam leaking from the gap between the second inner casing 22 and the outer casing 23 also flows through the labyrinth 73 as the leaked steam 83 toward the leaked-steam chamber 74.

As described above, this embodiment can ensure the following effects by the application of a double tube to the steam inlet unit of an ultrahigh-pressure top turbine, and by the provision of a triple-walled casing.

The round tubes 28, 29, which are separate from the outer casing 23 and are connected to the coupling 25, 26 of the outer casing by seal rings 31*a*, 31*c*, are used in the steam inlet unit, resulting in a structure which facilitates the inspection, manufacture, or disassembly of the outer casing and the main steam inlet coupling unit.

The use of the two round inlet tube and the cooling steam from the intermediate stage of the turbine stages installed within the double-walled inner casing reduces the differences in both pressure and temperature between the interior and the exterior of each round inlet tube. This enables a reduction in a wall thickness of the round inlet tubes, and eliminates the need for a thermal insulating layer which is required in a conventional structure, thus resulting in an inlet tube structure which is subjected to less thermal stresses generated therein.

The double-walled structure of the inner casing reduces the difference in pressure between the interior and exterior of each inner casing, so that the wall thickness of each inner casing can be reduced, and this structure also enables a reduction in difference in temperature between the interior and the exterior of each inner casing, so that the generated thermal stresses are even smaller.

Moreover, although expensive heat-resistant austenite steel must be used for parts such as the outlet portion of the nozzle box in the inner casing which are subjected to high-temperature steam, this high-grade, heat-resistant steel need only be used for the first inner casing, so that heat-resistant ferrite steel can be used for the second inner casing. As a result, this structure has an economic advantageous over the single-walled inner casing structure of the prior art.

Since the main steam inlet coupling unit is cooled by the cooling steams to temperatures that drop step-by-step, i.e., by the primary cooling steam and then the secondary cooling steam, no excessive thermal stresses occur in the coupling unit, and it is also possible to prevent heat transfer from the main steam inlet tube to the outer casing made of heat-resistant ferrite steel.

The discharge tube of the ultrahigh-pressure top turbine is positioned opposite the final stage thereof, so that the discharge steam 51 can be made to flow through the discharge chamber 33 defined between the inner casing. In particular, the outer wall of the second inner casing can be cooled efficiently.

The double-walled inner casing makes it possible to provide the leaked-steam chamber 74 independently of the extracted cooling-steam chamber 34 between the shaft-sealing portions 71 and 72, as shown in FIG. 4. By introducing the discharge steam into the leaked-steam chamber 74, it is possible to prevent the leaked steam 81 from the first inner casing at higher temperature from leaking toward the second inner casing.

According to the present invention, as described above, a steam inlet unit is constituted by a double tube which is detachable from the casing, so that disassembly for checking is facilitated, and product inspection is also facilitated because of the absence of welded joints in the interior of the coupling. Since the round inlet tubes are connected to the coupling unit on the casing side by seal rings, it is possible to eliminate the presence of parts which have abruptly-varying wall thickness, unlike the conventional structure. This results in fewer concentrations of thermal stresses and an improved reliability.

The structure is also arranged so that cooling steam extracted from an intermediate stage of the ultrahigh-pressure top turbine is made to flow between the round inlet tubes, and that steam discharged from the ultrahigh-pressure top turbine is made to flow as cooling steam between the outer round inlet tube and the outer casing, so that both temperature and pressure decrease gradually in the direction from the center of the round inlet tubes toward the exterior thereof. As a result, the thermal stresses acting on each of the round inlet tubes and the tensile stresses due the internal pressure therein are reduced, and this enables a reduction in the wall thickness of each round inlet tube.

What is claimed is:

1. A main steam inlet structure of a steam turbine provided with a turbine rotor with a plurality of blades, an inner casing which has nozzles and diaphragms with stationary blades in the interior thereof, and an outer casing surrounding the inner casing with a spacing for exhaust steam therebetween, which comprises:

a first inlet tube connected to said inner casing at one end thereof and at the other end to said outer casing for introducing main steam into said nozzles therethrough; and a second inlet tube, surrounding said first inlet tube with a spacing therebetween, connected to said outer casing at one end thereof and at the other end to said inner casing, said spacing between said first and second inlet tubes forming a first cooling passage communicating with an intermediate stage of the turbine for passing steam extracted from said intermediate stage through thereby cooling said first inlet tube, said extracted steam being lower in temperature and pressure than the main steam in said first inlet tube and higher than steam exhausted from the turbine.

2. The main steam inlet structure for a steam turbine according to claim 1, wherein said first and second inlet tubes are round in section and separably connected to said inner and outer casings, respectively, by seal rings.

3. The main steam inlet structure for a steam turbine according to claim 1 or 2, wherein a second cooling passage of an annular section which extends in the axial direction of said second inlet tube is formed between the outer wall of said second inlet tube and said outer casing to which one end of said second inlet tube is connected, and the steam discharged from said steam turbine is introduced into said second cooling passage.

4. The main steam inlet structure for a steam turbine according to claim 1 or 2, wherein said inner casing comprises a first inner casing surrounding high-pressure stages of said turbine including a nozzle box proved with said nozzles, and a second inner casing surrounding low-pressure stages of said turbine, one end of said first inlet tube being connected to said first inner casing, and one end of said second inlet tube being connected to said second inner casing.

5. The main steam inlet structure for a steam turbine according to claim 4, wherein an extracted cooling-steam chamber is formed between the outer wall of said first inner casing and the inner wall of said second inner casing, said chamber communicating with said first cooling passage whereby steam extracted from between said high-pressure stages and said low-pressure stages is introduced into said steam chamber.

6. The main steam inlet structure for a steam turbine according to claim 5, wherein said first cooling passage of an annular section which is formed between said first and second inlet tubes communicates with said extracted cooling-steam chamber.

7. The main steam inlet structure for a steam turbine according to claim 3, wherein said second and first inlet tubes are connected to said outer casing by second and first main steam inlet couplings integral with said outer casing, respectively, and said couplings are provided with first and second cooling-steam discharge ports which communicate with said first and second cooling passages, respectively.

8. The main steam inlet structure for a steam turbine according to claim 7, wherein said first and second cooling-steam discharge ports are connected by a cooling-steam recovery line to a system at a lower pressure than that of said cooling steam, and a flow-regulating valve is provided in said recovery line.

9. A main steam inlet structure for a steam turbine provided with a turbine rotor with a plurality of blades, an inner casing which has nozzles and diaphragms with stationary blades in the interior thereof, and an outer casing surrounding the inner casing with a spacing therebetween, a first inlet tube connected to said inner casing at one end thereof and at the other end to said outer casing for introducing main steam into said nozzles therethrough, and a cooling passage formed between said first inlet tube and said outer casing, for passing steam exhausted from said turbine through thereby cooling said first inlet tube, characterized by a second inlet tube, surrounding said first inlet tube with a spacing therebetween and connected to said outer casing at one end thereof and at the other end to said inner casing;

a first cooling passage formed between said first inlet tube and said second inlet tube and communicating with an intermediate stage of said turbine for passing steam extracted from said intermediate stage through thereby cooling said first inlet tube, said extracted steam flowing in an opposite direction to said main steam flow in said first inlet tube; and a second cooling passage formed between said second inlet tube and said outer casing and communicating with a low-pressure stage of said turbine for passing steam discharged from said low-pressure stage through thereby cooling said second inlet tube, said discharged steam flowing in the opposite direction to said main steam flow in said first inlet tube, said extracted steam in said first cooling passage being lower in temperature and pressure than said main steam in first inlet tube and being higher than said discharged steam in said second cooling passage.

10. The main steam inlet structure for a steam turbine according to claim 9, characterized in that said inner casing comprises a first inner casing surrounding high-pressure stages of said turbine including a nozzle box provided with said nozzles, and a second inner casing surrounding low-pressure stages of said turbine, one end of said first inlet tube being connected to said first inner casing, one end of said second inlet tube being connected to said second inner casing, and said extracted steam passing through an extracted cooling-chamber, cooling an outer wall of said first inner casing, and flowing into said first cooling passage.

11. A main steam inlet structure of a steam turbine provided with a turbine rotor with a plurality of blades, an inner casing which has nozzles and diaphragms with stationary blades in the interior thereof, and an outer casing surrounding the inner casing with a spacing for exhaust steam therebetween and having an inlet portion joined, by welding, to a main steam tube leading to a boiler, which comprises;

a first inlet tube connected to said inner casing at one end thereof and at the other end to said inlet portion of said outer casing for introducing main steam from said main steam tube into said nozzles therethrough;

a second inlet tube surrounding said first inlet tube with a spacing therebetween, connected to said inlet portion of said outer casing at one end thereof and at the other end to said inner casing;

a first cooling passage, defined between said first and second inlet tubes and communicating with an intermediate stage of the turbine and a first cooling-steam discharge port provided in said inlet portion of said outer casing, whereby the extracted steam from the turbine is discharged out of said outer casing through said first cooling passage and said first cooling-steam discharge port while cooling said first inner tube; and a second cooling passage defined by an inner wall of said outer casing and the outer surface of said second inner tube, and communicating with a low-pressure stage of the turbine and a second cooling-steam discharge port provided in said inlet portion of said outer casing whereby the exhausted steam form the turbine is discharged out of said outer casing through said second cooling passage and said second cooling-steam discharge port while cooling said second inlet tube.

* * * * *